US010988310B2

(12) United States Patent
Moore

(10) Patent No.: US 10,988,310 B2
(45) Date of Patent: Apr. 27, 2021

(54) TRASH RECEPTACLE

(71) Applicant: Catrice Reimon Moore, Cape Girardeau, MO (US)

(72) Inventor: Catrice Reimon Moore, Cape Girardeau, MO (US)

( * ) Notice: Subject to any disclaimer, the term of this patent is extended or adjusted under 35 U.S.C. 154(b) by 67 days.

(21) Appl. No.: 16/292,265

(22) Filed: Mar. 4, 2019

(65) Prior Publication Data

US 2019/0270585 A1 Sep. 5, 2019

Related U.S. Application Data

(60) Provisional application No. 62/637,782, filed on Mar. 2, 2018.

(51) Int. Cl.

| | |
|---|---|
| ***B65F 1/14*** | (2006.01) |
| ***A47L 5/38*** | (2006.01) |
| *B65F 1/16* | (2006.01) |
| *B65F 1/00* | (2006.01) |

(52) U.S. Cl.

CPC ..... *B65F 1/1426* (2013.01); *A47L 5/38* (2013.01); *B65F 1/0053* (2013.01); *B65F 1/16* (2013.01)

(58) Field of Classification Search

CPC ..... B65D 43/26; B65F 3/02; B65F 1/1426; B65F 1/16; B65F 1/0053; B65F 1/1473; B65F 2210/179; B65F 2210/128; B65F 1/068; B65F 1/1607; B65F 1/1638; B65F 2210/168; B65F 2210/169; B65F 2003/0236; B65F 2210/188; B65F 1/1421; A47L 5/38

See application file for complete search history.

(56) References Cited

U.S. PATENT DOCUMENTS

| | | | | |
|---|---|---|---|---|
| 6,010,024 | A * | 1/2000 | Wang | B65F 1/163 220/23.87 |
| 6,199,714 | B1 | 3/2001 | Thompson | |
| 6,253,949 | B1 | 7/2001 | Dickson | |
| 6,345,725 | B1 * | 2/2002 | Lin | B65F 1/1607 220/263 |
| 7,530,578 | B2 * | 5/2009 | Niemeyer | B65F 1/1473 220/262 |
| 7,578,511 | B2 | 8/2009 | Sheehan | |
| 8,678,219 | B1 * | 3/2014 | Wang | B65F 1/163 220/211 |
| 2002/0108507 | A1 | 8/2002 | May | |
| 2009/0057317 | A1 * | 3/2009 | Wang | B65F 1/1426 220/495.06 |
| 2010/0025509 | A1 | 2/2010 | Matlin | |
| 2016/0176630 | A1 | 6/2016 | Shahabdeen | |

* cited by examiner

*Primary Examiner* — Kareen K Thomas
(74) *Attorney, Agent, or Firm* — Runyan Law; Charles Runyan

(57) ABSTRACT

A trash receptacle; the trash receptacle includes a housing, a vacuum, a lid, at least one lid-opening means, a controller and a power source. In some embodiments, the trash receptacle includes a paper-shredder, a voice-command unit, a motive-system, a user-display and a capacity-sensor. The trash receptacle provides users with an improved trash receptacle capable of making trash collecting and disposal much easier and more convenient.

20 Claims, 6 Drawing Sheets

TRASH RECEPTACLE

CROSS REFERENCE TO RELATED APPLICATION

The present application is related to and claims priority to U.S. Provisional Patent Application No. 62/637,782 filed Mar. 2, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of trash and more specifically relates to trash receptacles.

2. Description of Related Art

Standard trash receptacles conventionally include a base section equipped with a sliding or rotating lid. The lid is opened, a trash bag is placed within the receptacle, and users can then begin filling the bag with trash. Manually opening and closing the trash receptacle can be frustrating and unsanitary. People may be unaware as to when he/she needs to replace the trash bag—an individual may go to place trash in the trash bag only to discover it is full. A suitable solution is desired.

U.S. Pub. No. 2016/0176630 to Junaith Ahemed Shahabdeen relates to a smart garbage bin. The described smart garbage bin includes a container (e.g., a garbage bin or document disposal bin) which includes a sensor for sensing a quantity indicative of the amount of items deposited into the container, and a local controller capable of wireless communication with a remote controller for sending the sensed data to the remote controller. The sensor may be mounted on the cover or at the bottom of the container. The sensor placed on the cover may be a range finder that measures the distance between the container and its content. The sensor that is placed at the bottom of the container may be sensitive to the weight of the container and its contents. The sensor may be, for example, a reflective IR range finder, or a pressure sensor, such as a force sensing resistor. In addition, the sensed quantity may be the presence of a gaseous compound, such as hydrogen sulfide, ammonia and methane.

BRIEF SUMMARY OF THE INVENTION

In view of the foregoing disadvantages inherent in the known trash art, the present disclosure provides a novel trash receptacle. The general purpose of the present disclosure, which will be described subsequently in greater detail, is to provide an improved trash receptacle capable of making trash collecting and disposal much easier and more convenient.

A trash receptacle is disclosed herein. The trash receptacle includes a housing which may include an inner-capacity defined by an outer-shell, an open-bottom and an open-top opposite the open-bottom; and a vacuum which may be located about a bottom-end of the housing. A lid may be provided and configured to selectively cover the open-top of the housing. Further, at least one lid-opening means may be attached to the housing and configured to at least partially uncover the lid from the open-top of the housing. In addition, a controller may be disposed within the housing and communicably coupled to the at least one lid-opening means. A power source may be coupled to the housing and configured to provide power to the trash receptacle.

A method of using trash receptacle is also disclosed herein. The method of using trash receptacle may comprise the steps of: providing the trash receptacle as above; uncovering the lid from the open-top of the housing via the at least one lid-opening means; lining the inner-capacity of the housing with a trash receptacle liner; filling the inner-capacity of the housing with trash; and uncovering the lid from the open-top of the housing via the at least one lid-opening means; and removing the trash receptacle liner from the inner-capacity of the housing.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a trash receptacle, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to trash and more particularly to a trash receptacle as used to improve the efficient and effective use of trash receptacles.

Generally disclosed is a trash receptacle which may feature a top motion sensor designed to slide back a lid of the trash receptacle and a bottom motion sensor capable of sliding open the lid for simple and smooth trash bag changes. The trash receptacle may include an open bottom equipped with a vacuum for cleaning up additional trash, dirt, and debris near the trash receptacle. Further, the trash receptacle may include an optional voice command unit in order to control various functions of the trash can such as opening and closing the lid, operating the vacuum, and/or operating an optional paper shredder.

The trash receptacle may be of a slim design consisting of a cylindrical structure having a decorative 3D design (which is functional), with the lid and a bottomless base. The bottomless base may include an integrated vacuum and wheels. Each trash receptacle may be lightweight and may be activated via the motion sensors or voice commands. The motion sensors can be activated by waving a hand or foot in front of the sensor. If no motion or commands occur for approximately five minutes, the lid may automatically close.

An optional built-in paper shredder may be included in some models. The slim design may be battery operated and may notifies owners when the trash receptacle is full. A built-in light can assist with seeing at night. Each trash receptacle may also include optional touchscreens in order to input commands similar to the sensors and voice activation. There may be an external device located underneath a sink that allows the trash receptacle to know where to come and stop. This may prevent leaking content from the sink to trash receptacle. The trash receptacle may return to a base location at a preset time after the lid is closed.

Functions of the trash receptacle may be designed to offer simplicity and convenience when filling, replacing, and disposing of trash bags. The trash receptacle may be constructed using plastic, aluminum, and other suitable materials. The receptacles may be available in various sizes and designs in order to accommodate all user needs and preferences.

Referring now more specifically to the drawings by numerals of reference, there is shown in FIGS. 1-5, various views of a trash receptacle 100.

Figure 1:
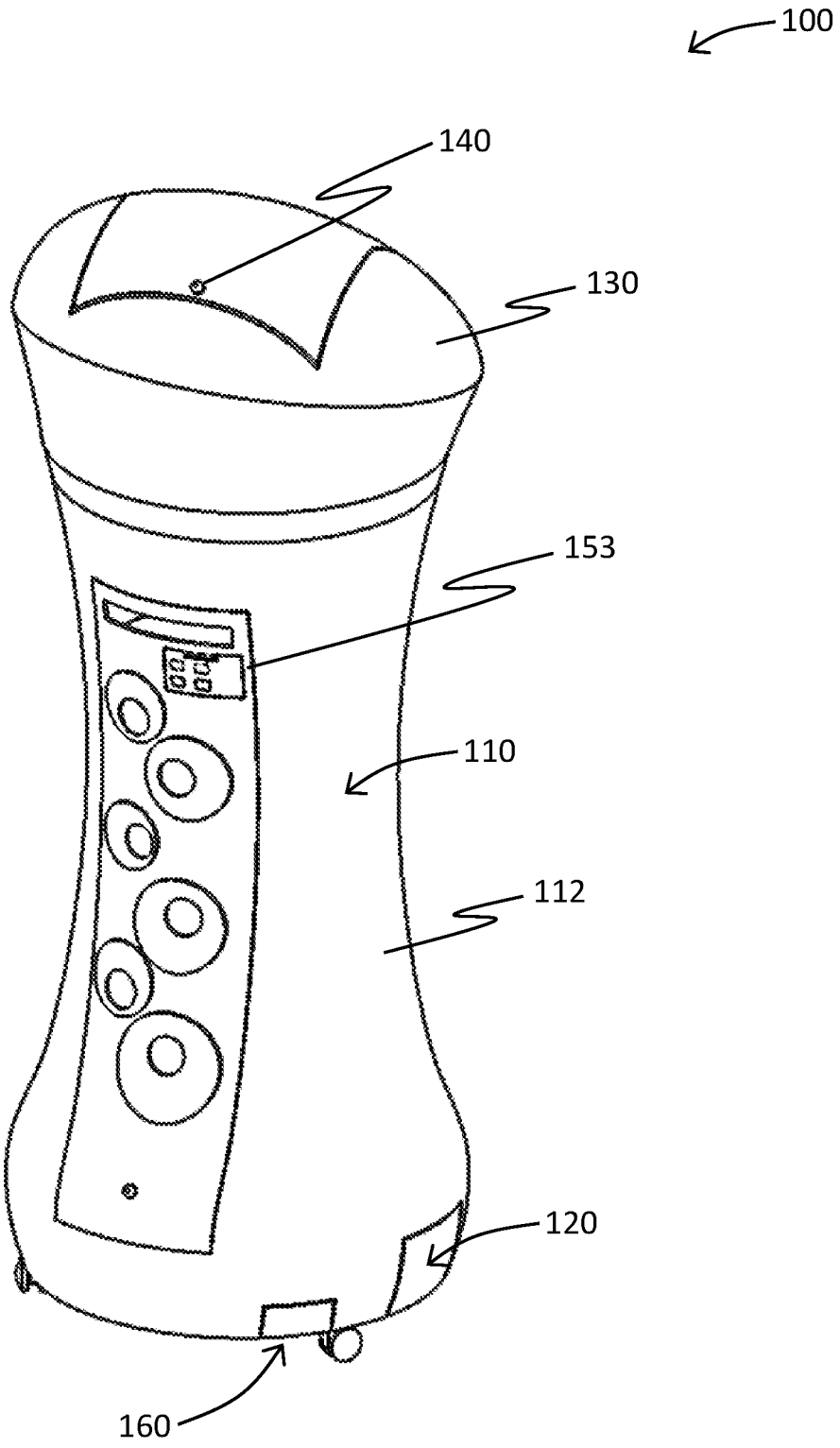
FIG. 1 is a front-side perspective view of the trash receptacle during an 'in-use' condition, according to an embodiment of the disclosure.

FIG. 1 shows a trash receptacle 100 during an 'in-use' condition 150, according to an embodiment of the present disclosure. As illustrated, the trash receptacle 100 may include a housing 110, a vacuum 120, a lid 130, at least one lid-opening means 140, a controller 150 (FIG. 5) and a power source 160. In addition to this, the trash receptacle 100 may include a user-display 153 located on an outer-surface of an outer-shell 112 of the housing. The user-display 153 may include a user-interface for receiving a command from the user. Preferably, the user-interface may be a touchscreen.

Figure 2:
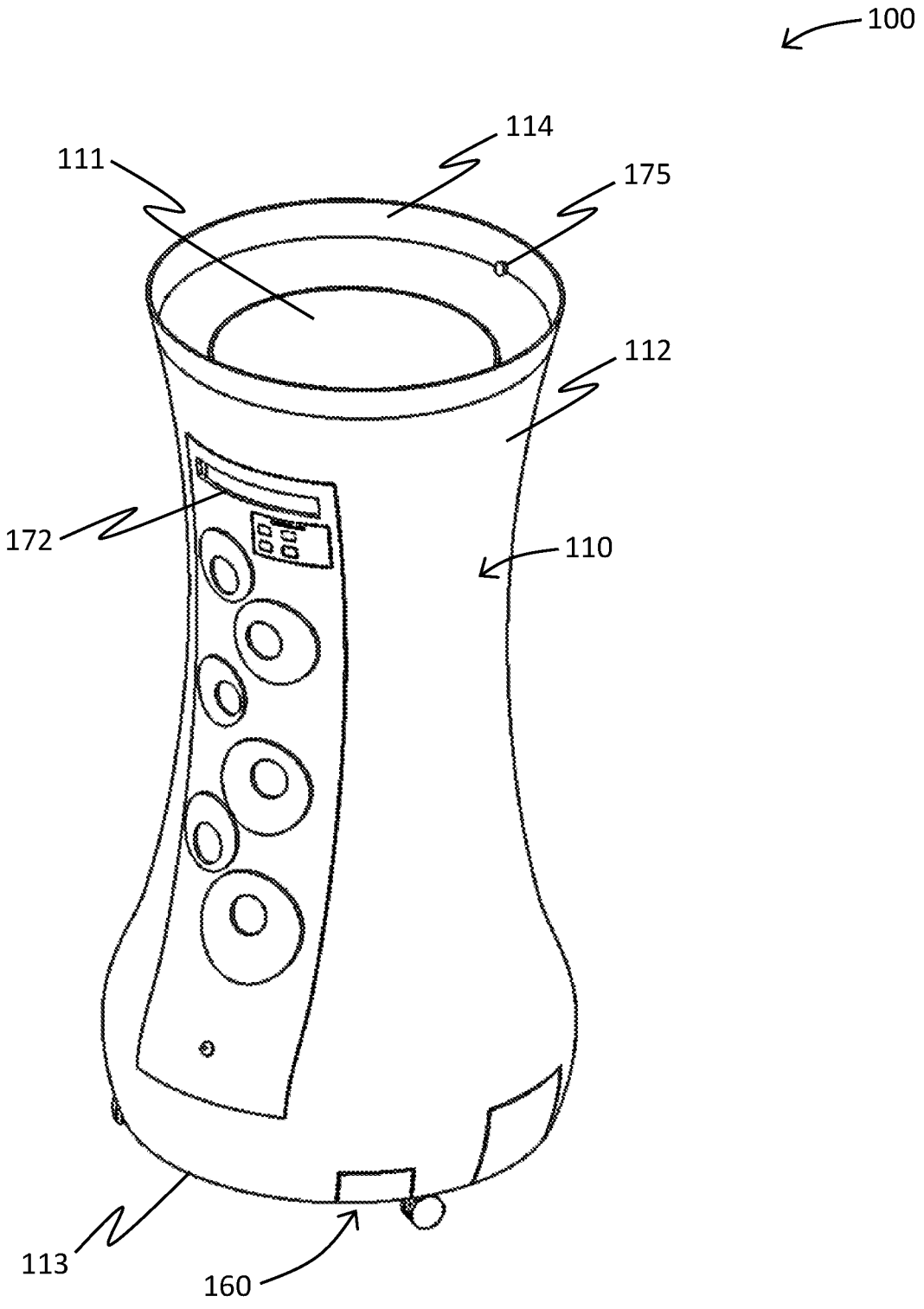
FIG. 2 is a front-side perspective view of the trash receptacle of FIG. 1, according to an embodiment of the present disclosure.

FIG. 2 shows a front perspective view of the trash receptacle 100 of FIG. 1, according to an embodiment of the present disclosure. The housing 110 may include an inner-capacity 111 defined by an outer-shell 112, an open-bottom 113 and an open-top 114 opposite the open-bottom 113. Preferably, the housing 110 may include a cylindrical shape. Further, as shown, the trash receptacle 100 may include a paper-shredder 172 located in the housing 110. In addition, the trash receptacle 100 may include a light 175 attached to an inner-surface of the outer-shell 112 and configured to illuminate the inner-capacity. The power source 160 may be coupled to the housing 110, the power source 160 configured to provide power to the trash receptacle. Preferably, the power source 160 may be a battery, or a plurality of batteries. The battery may be rechargeable or disposable. Batteries considered may be lithium-ion, alkaline, nickel-cadmium, nickel-metal hydride, etc.

Figure 3A:
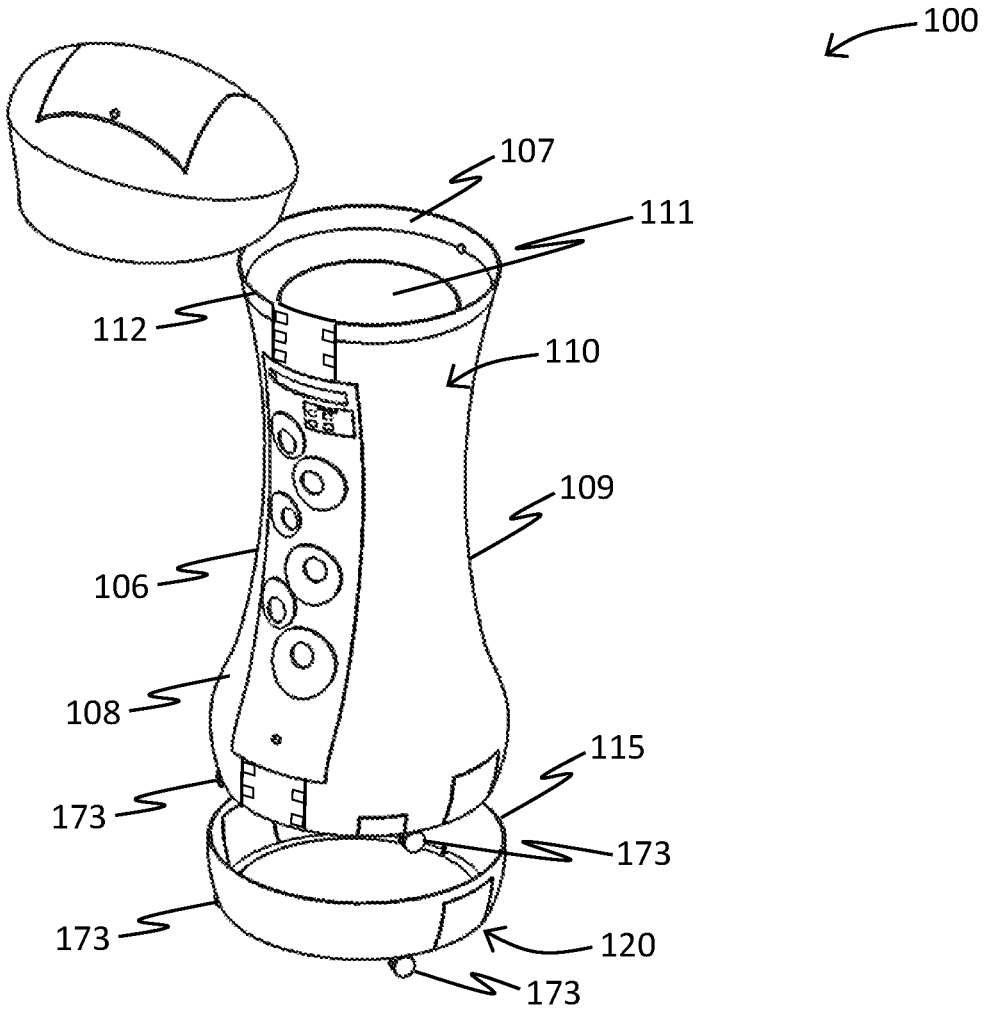
FIG. 3A is a front perspective view of the trash receptacle of FIG. 1, according to an embodiment of the present disclosure.
Figure 3B:
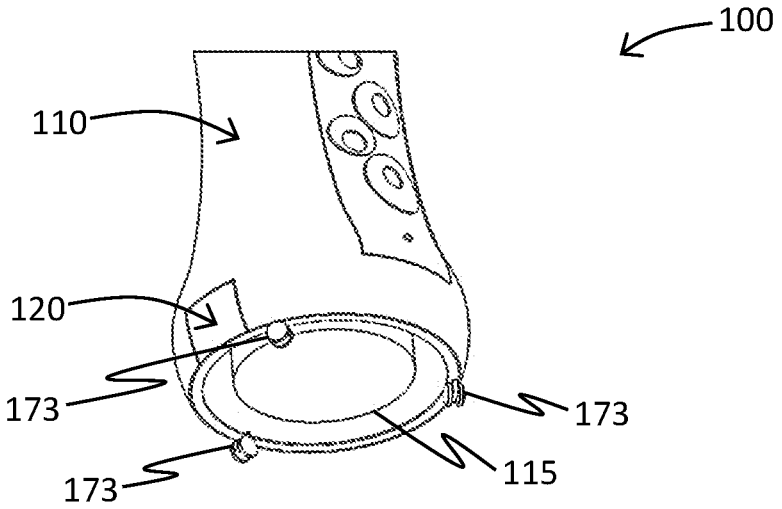
FIG. 3B is a bottom perspective view of the trash receptacle of FIG. 1, according to an embodiment of the present disclosure.

FIGS. 3A-3B show perspective views of the trash receptacle 100 of FIG. 1, according to an embodiment of the present disclosure. As shown, the vacuum 120 may be located about a bottom-end 115 of the housing 110. The vacuum 120 may include an inlet coupled to a suction means for suctioning dirt, debris, trash, etc. around the trash receptacle. In one embodiment, suctioned dirt, debris, trash, etc. may be directed into the inner-capacity 111 of the housing 110. In another embodiment, the vacuum 120 may include a filter and a bag for collecting the dirt, debris, trash, etc. in a separate area of the housing 110. Preferably, the bottom-end 115 of the housing 110 may be detachable from the housing 110. This may be beneficial to a user for use of the vacuum 120, as they are able to remove the vacuum 120 from the housing 110. Further, as shown, the trash receptacle 100 may further include one or more wheels 173 located on the bottom-end 115 of the housing 110.

As shown here, the outer-shell 112 of the housing 110 may include a front-side 106 and a rear-side 107. The front-side 106 may include a first front-side 108 and a second front-side 109. Preferably, the first front-side 108 and the second front-side 109 may be selectively separable, or severable, such that the front-side 106 is able to split in half to expose the inner-capacity 111 of the housing 110. Thus, the user may be able to remove a trash liner located within the inner-capacity 111, or remove trash located in the inner-capacity 111.

Figure 4A:
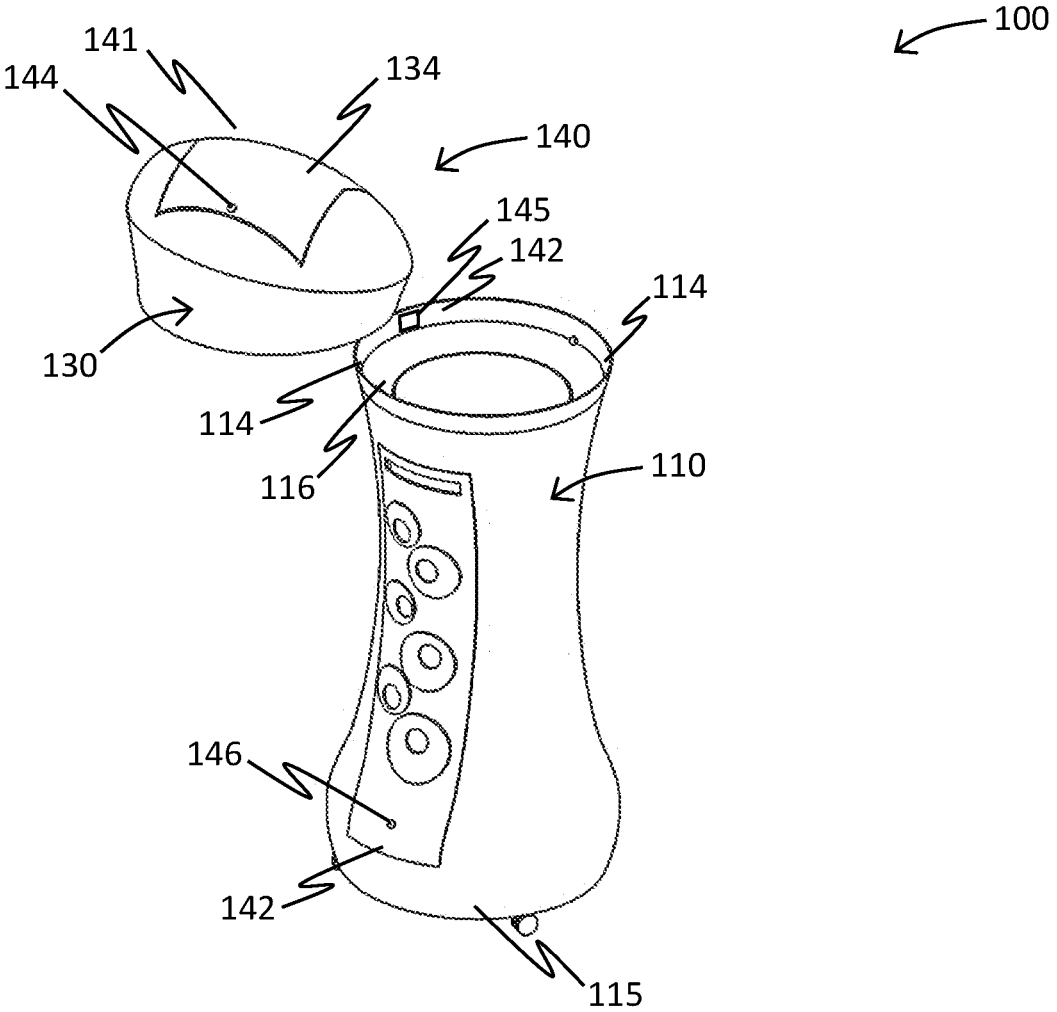
FIG. 4A is a front-side perspective view of the trash receptacle of FIG. 1, according to an embodiment of the present disclosure.
Figure 4B:
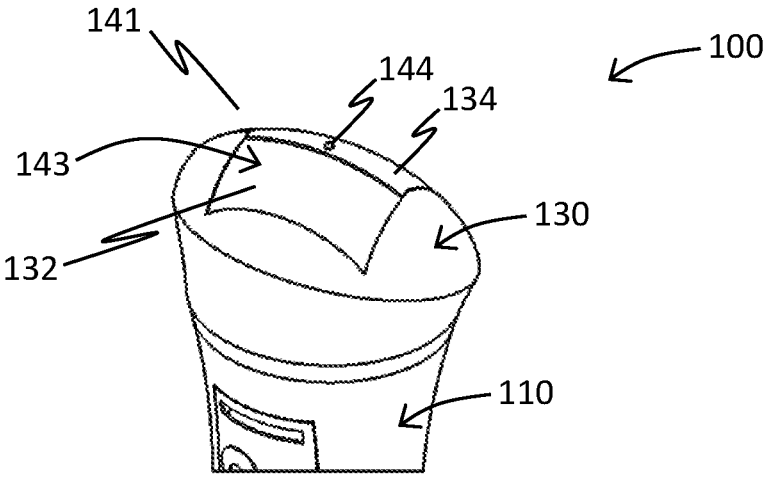
FIG. 4B is a front-side perspective view of the trash receptacle of FIG. 1, according to an embodiment of the present disclosure.

FIGS. 4A-4B show perspective views of the trash receptacle 100 of FIG. 1, according to an embodiment of the present disclosure. As above, the lid 130 may be provided. The lid 130 may be configured to selectively cover the open-top 114 of the housing 110. In one embodiment, the lid 130 may include an opening 132 and a door 134 configured to selectively cover the opening 132.

The at least one lid-opening means 140 may be attached to the housing 110 and configured to at least partially uncover the lid 130 from the open-top 114 of the housing 110. Preferably, the at least one lid-opening means 140 may include a first lid-opening means 141 and a second lid-opening means 142. The first lid-opening means 141 may include a first lid-mover 143 and a first motion sensor 144. Similarly, the second lid-opening means 142 may include a second lid-mover 145 and a second motion sensor 146. In one embodiment, the first lid-mover 143 and the second lid-mover 145 may both be motors. However, other means are contemplated, such as magnets.

The first motion sensor 144 may be located on the door 134 of the lid 130 and first lid-mover 143 may be configured to move the door 134 from a closed-position to an open-position upon receipt of a signal from the first motion sensor 144 that movement is detected. The first motion sensor 144 may be at arm height of the user to enable the user to trigger the first lid-mover 143 by moving their arms near the first motion sensor 144.

Further, the second motion sensor 146 may be located about the bottom-end 115 of the housing 110. The second motion sensor 146 may be at foot height of the user to enable the user to trigger the second-lid mover 145 by moving their feet near the second motion sensor 146. The second-lid mover 145 may be configured to slide the lid 130 substantially off the open-top 114 of the housing 110. In this embodiment, the lid 130 may be at least partially locked to the top-end 116 of the housing 110 so that the lid 130 is able to be moved from the open-top 114 far enough to allow the user to remove the trash liner, or trash in the inner-capacity 111, but is able to stay put on the housing 110.

Figure 5:
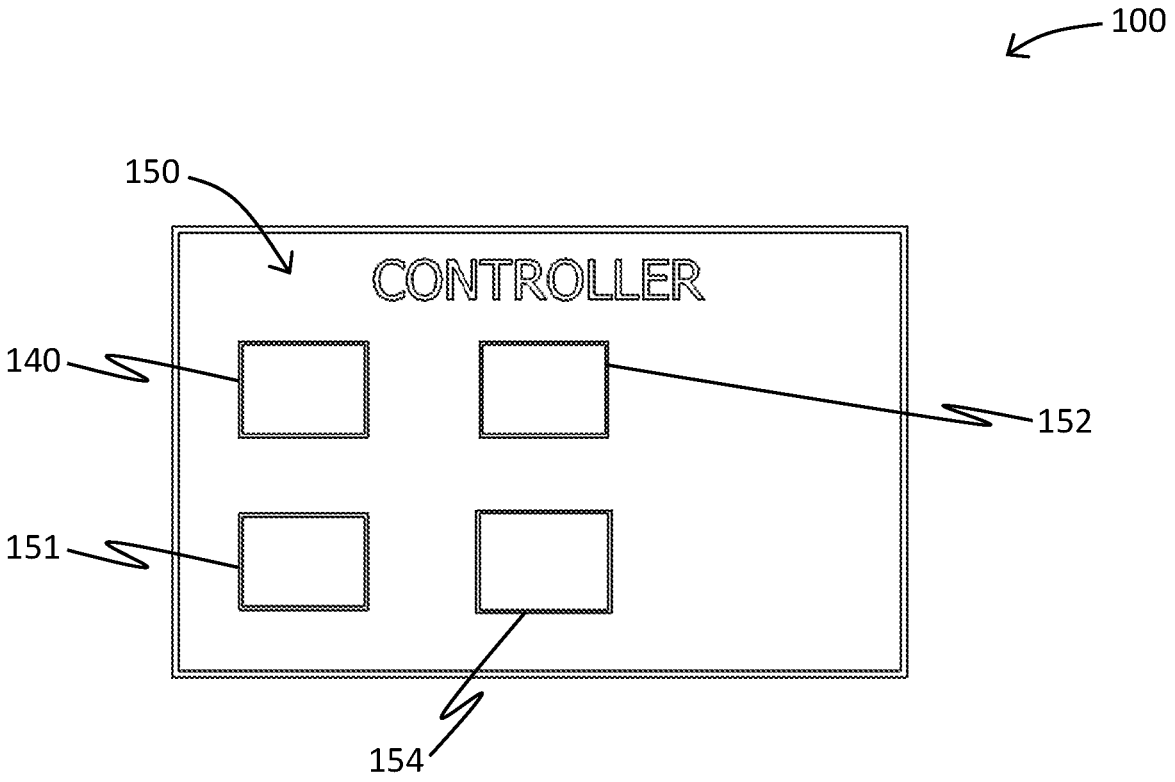
FIG. 5 is a front perspective view of the trash receptacle of FIG. 1, according to an embodiment of the present disclosure.

FIG. 5 shows a front perspective view of the trash receptacle 100 of FIG. 1, according to an embodiment of the present disclosure. The controller 150 may be disposed within the housing 110 (FIG. 4A) and communicably coupled to the at least one lid-opening means 140. The controller 150 may receive a signal from either the first motion sensor 144 (FIG. 4A) or the second motion sensor 146 (FIG. 4A) and actuate the appropriate lid-mover. For example, if the controller 150 receives a signal from the first motion sensor 144 (FIG. 4A), the controller 150 may actuate the first lid-mover 143 (FIG. 4A) to open the door 134 (FIG. 4B) of the lid 130 (FIG. 4B).

In another example, if the controller 150 receives a signal from the second motion sensor 146 (FIG. 4A), the controller 150 may actuate the second lid-mover 145 (FIG. 4A) to move the lid 130 off of the housing 110 (FIG. 4A) to expose the open-top 114 (FIG. 4A) and inner-capacity. In the first example, the first motion sensor 144 (FIG. 4A) may be used when the user wants to add trash to the inner-capacity 111 (FIG. 4A).

In the second example, the second motion sensor 146 (FIG. 4A) may be used when the user needs to empty the inner-capacity 111 (FIG. 4A). To aid in this, the trash receptacle 100 may include a capacity-sensor 174 disposed within the housing 110 (FIG. 4A) and configured to sense a trash-capacity of the inner-capacity 111 (FIG. 4A). The controller 150 may then be configured to generate a capacity-notification upon receipt of a capacity-signal from the capacity-sensor. For example, the trash-capacity may sense that the inner-capacity 111 (FIG. 4A) has become full. The capacity-signal may then be received by the controller 150 and the controller 150 may output the capacity-notification. The capacity-notification may be an alarm such as a sound, or a visual alarm.

Further to this, the trash receptacle 100 may include a voice-command unit 151 disposed within the housing 110 (FIG. 4A) and communicably coupled to the controller 150. The voice-command unit 151 may be configured to analyze a command made by the user, such as "open lid", create an electrical signal and actuate the appropriate response.

The trash receptacle 100 may include a motive-system 152 disposed within the housing 110 (FIG. 4A) and communicably coupled to the controller 150. The motive system 152 may be configured to allow movement of the trash receptacle 100 over a floor-surface. This may be aided by the one or more wheels 173 (FIG. 3B) located on the bottom-end 115 (FIG. 3B) of the housing 110 (FIG. 3B). In one embodiment, the motive system 152 may include sensors to aid the trash receptacle 100 in moving around the floor-surface, such as to prevent the trash receptacle 100 from crashing into items, getting stuck on items that are not suction-able, etc.

Further, sensors may be used to provide guidance to the trash receptacle 100. In addition to this, a wireless communication means 154 may be provided. The wireless communication means 154 may be configured to communicate with an external device. In one embodiment wireless communication may provide guidance to the trash receptacle 100. For example, the external device may be placed in an area, and the wireless communication may guide the trash receptacle 100 to the external device. Further, a remote (not illustrated) may be provided with the trash receptacle 100 and communicably coupled to the trash receptacle 100. The remote may further include a voice command module which may enable the user to speak (voice command) into the remote, which would actuate the appropriate feature of the trash receptacle as dictated by the voice command spoken by the user. For example, the user may say "open lid" into the remote, and the remote may actuate the at least one lid opening-means 140.

Figure 6:
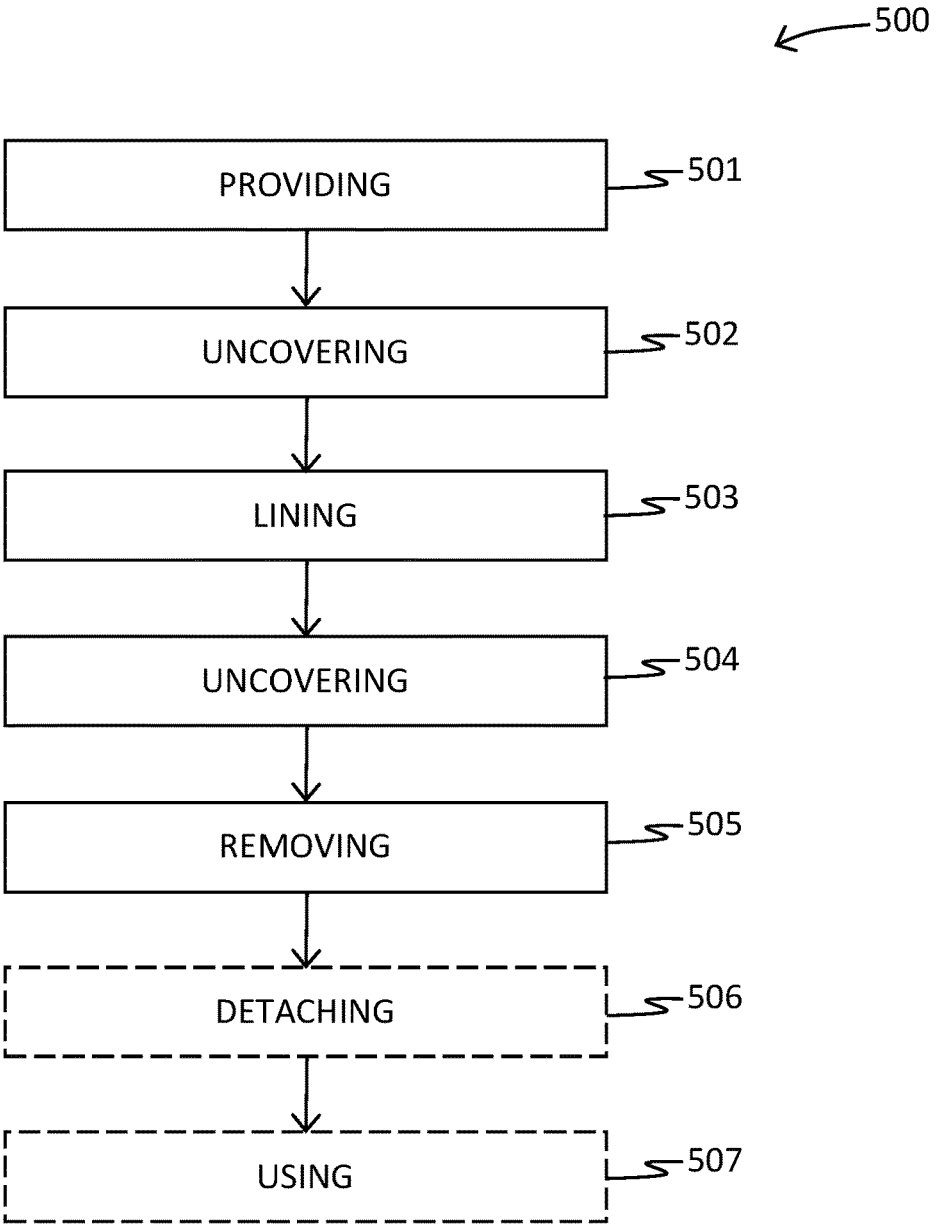
FIG. 6 is a flow diagram illustrating a method of use for trash receptacle, according to an embodiment of the present disclosure.

FIG. 6 is a flow diagram illustrating a method of using a trash receptacle 500, according to an embodiment of the present disclosure. As illustrated, the method of using a trash receptacle 500 may include the steps of: providing 601 the trash receptacle as above; uncovering 602 the lid from the open-top of the housing via the at least one lid-opening means; lining 603 the inner-capacity of the housing with a trash receptacle liner; filling 604 the inner-capacity of the housing with trash; and uncovering 605 the lid from the open-top of the housing via the at least one lid-opening means; and removing 606 the trash receptacle liner from the inner-capacity of the housing. Further steps may include detaching 607 the bottom-end of the housing from the housing; and using 608 the vacuum to suction at least one of trash, dirt and debris into the inner-capacity of the housing.

It should be noted that steps 607 and 608 are optional steps and may not be implemented in all cases. Optional steps of method of use 500 are illustrated using dotted lines in FIG. 6 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for trash receptacle 100 use (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A trash receptacle comprising:

a housing including an inner-capacity defined by an outer-shell, the housing further including an open-bottom and an open-top opposite the open-bottom;

a vacuum located about a bottom-end of the housing;

a lid configured to cover the open-top of the housing;

at least one lid-opening means attached to the housing, the at least one lid-opening means configured to at least partially uncover the lid from the open-top of the housing;

a controller disposed within the housing, the controller being communicably coupled to the at least one lid-opening means; and a power source coupled to the housing, the power source configured to provide power to the trash receptacle.

2. The trash receptacle of claim 1, further comprising a paper-shredder located in the housing.

3. The trash receptacle of claim 1, further comprising a voice-command unit disposed within the housing and communicably coupled to the controller.

4. The trash receptacle of claim 1, further comprising one or more wheels located on a bottom-end of the housing.

5. The trash receptacle of claim 1, further comprising a motive-system disposed within the housing communicably coupled to the controller, the motive system configured to allow movement of the trash receptacle over a floor-surface.

6. The trash receptacle of claim 1, further comprising a user-display located on an outer-surface of the outer-shell.

7. The trash receptacle of claim 6, wherein the user-display includes a user-interface.

8. The trash receptacle of claim 7, wherein the user-interface is a touchscreen.

9. The trash receptacle of claim 1, further comprising a capacity-sensor disposed within the housing and configured to sense a trash-capacity of the inner-capacity.

10. The trash receptacle of claim 1, further comprising a wireless communication means, the wireless communication means being configured to communicate with an external device.

11. The trash receptacle of claim 1, further comprising a light attached to an inner-surface of the outer-shell, the light configured to illuminate the inner-capacity.

12. The trash receptacle of claim 1, wherein the at least one lid-opening means includes a first lid opening-means and a second-lid opening means.

13. The trash receptacle of claim 12, wherein the first lid-opening means includes a first lid-mover and a first motion sensor; and wherein second lid opening-means includes a second lid-mover and a second motion sensor.

14. The trash receptacle of claim 1, wherein the lid includes an opening and a door configured to cover the opening.

15. The trash receptacle of claim 1, wherein the bottom-end of the housing is detachable from the housing.

16. The trash receptacle of claim 1, wherein the outer-shell of the housing includes a front-side and a rear-side.

17. The trash receptacle of claim 16, wherein the front-side includes a first front-side and a second front-side; and wherein the first front-side and second front-side are separable.

18. A trash receptacle comprising:

a housing including an inner-capacity defined by an outer-shell, the housing further including an open-bottom and an open-top opposite the open-bottom;

a vacuum located about a bottom-end of the housing;

a lid configured to cover the open-top of the housing;

at least one lid-opening means attached to the housing, the at least one lid-opening means configured to at least partially uncover the lid from the open-top of the housing;

a controller disposed within the housing, the controller being communicably coupled to the at least one lid-opening means;

a paper-shredder located in the housing;

a voice-command unit disposed within the housing and communicably coupled to the controller;

one or more wheels located on a bottom-end of the housing;

a motive-system disposed within the housing communicably coupled to the controller, the motive system configured to allow movement of the trash receptacle over a floor-surface;

a user-display located on an outer-surface of the outer-shell;

a capacity-sensor disposed within the housing and configured to sense a trash-capacity of the inner-capacity;

a wireless communication means, the wireless communication means being configured to communicate with an external device;

a light attached to an inner-surface of the outer-shell, the light configured to illuminate the inner-capacity; and a power source coupled to the housing, the power source configured to provide power to the trash receptacle; and wherein the user-display includes a user-interface;

wherein the user-interface is a touchscreen;

wherein the at least one lid-opening means includes a first lid opening-means and a second-lid opening means;

wherein the first lid-opening means includes a first lid-mover and a first motion sensor;

wherein second lid opening-means includes a second lid-mover and a second motion sensor;

wherein the lid includes an opening and a door configured to cover the opening;

wherein the bottom-end of the housing is detachable from the housing;

wherein the outer-shell of the housing includes a front-side and a rear-side;

wherein the front-side includes a first front-side and a second front-side; and wherein the first front-side and second front-side are separable.

19. A method of using a trash receptacle, the method comprising the steps of:

providing the trash receptacle comprising:

a housing including an inner-capacity defined by an outer-shell, the housing further including an open-bottom and an open-top opposite the open-bottom;

a vacuum located about a bottom-end of the housing;

a lid configured to cover the open-top of the housing;

at least one lid-opening means attached to the housing, the at least one lid-opening means configured to at least partially uncover the lid from the open-top of the housing;

a controller disposed within the housing, the controller being communicably coupled to the at least one lid-opening means; and a power source coupled to the housing, the power source configured to provide power to the trash receptacle;

uncovering the lid from the open-top of the housing via the at least one lid-opening means;

lining the inner-capacity of the housing with a trash receptacle liner;

filling the inner-capacity of the housing with trash; and uncovering the lid from the open-top of the housing via the at least one lid-opening means; and removing the trash receptacle liner from the inner-capacity of the housing.

20. The method of claim 19, further comprising the steps of:

detaching the bottom-end of the housing from the housing; and using the vacuum to suction at least one of trash, dirt and debris into the inner-capacity of the housing.

* * * * *